United States Patent [19]

Shaffer et al.

[11] 4,269,472

[45] May 26, 1981

[54] ELECTRICAL TERMINAL

[75] Inventors: Howard R. Shaffer; Thomas H. Wycheck, both of Harrisburg, Pa.

[73] Assignee: AMP Incorporated, Harrisburg, Pa.

[21] Appl. No.: 88,700

[22] Filed: Oct. 26, 1979

[51] Int. Cl.[3] ..... H01R 4/20

[52] U.S. Cl. ..... 339/223 R; 339/217 S; 339/259 R

[58] Field of Search ..... 339/97 C, 217 S, 223 R, 339/255 RT, 259, 276 T

[56] References Cited

U.S. PATENT DOCUMENTS

| | | | |
|---|---|---|---|
| 2,778,097 | 1/1957 | Berg | 29/193.5 |
| 2,816,275 | 12/1957 | Hammel | 339/273 |
| 2,903,670 | 9/1959 | Sitz | 339/128 |
| 2,943,293 | 6/1960 | Bucher et al. | 339/223 |
| 3,083,351 | 3/1963 | Nielsen, Jr. | 339/217 |
| 3,143,385 | 8/1964 | Zimmerman, Jr. et al. | 339/217 |
| 3,745,514 | 7/1973 | Brishka | 339/259 R |
| 3,957,337 | 5/1976 | Damiano | 339/217 S |
| 4,147,400 | 4/1979 | Snyder, Jr. et al. | 339/217 S |
| 4,150,866 | 4/1979 | Snyder, Jr. et al. | 339/94 M |

FOREIGN PATENT DOCUMENTS

| | | | |
|---|---|---|---|
| 2153248 | 5/1972 | Fed. Rep. of Germany | 339/276 T |
| 1313824 | 4/1973 | United Kingdom . | |

*Primary Examiner*—John McQuade
*Attorney, Agent, or Firm*—Russell J. Egan

[57] ABSTRACT

An improved electrical terminal is disclosed having a smooth surface of transition between a contact portion and a crimp portion of the terminal providing both strength for the terminal and an exterior surface which allows the terminal to be moved through a sealing membrane without damage to the membrane. The terminal is stamped and formed from conventional metal stock and has additional base material in an area formed into a conical shape by die tooling. When the terminal is crimped to a conductor, the transition and crimp area are simultaneously closed to provide a smooth strong transition between the crimp and the remainder of the terminal.

10 Claims, 5 Drawing Figures

ELECTRICAL TERMINAL

BACKGROUND OF THE INVENTION

1. The Field Of The Invention

The present invention relates to a stamped and formed electrical terminal and in particular to an electrical terminal having a configuration providing greater strength and improved operational characteristics.

2. The Prior Art

The previously known stamped and formed electrical terminals have had a variety of features which, at times, offset the cost benefits of such terminals and can even become disadvantages. For example, a terminal such as the one described in U.S. Pat. No. 3,083,351 has a crimped profile which presents a number of outwardly directed sharp projections which would destroy a seal if the terminal were to be inserted into or withdrawn from the seal. These terminals also have a certain amount of structural weakness in the area immediately adjacent the crimp portion which could prove to be the source of difficulty in inserting and/or withdrawing the terminal through a seal. A somewhat similar terminal is shown in U.S. Pat. No. 2,943,293. This terminal likewise has a number of sharp projections and an area of structural weakness.

An alternative to the previously discussed terminals is a screw machine formed terminal such as the one described in U.S. Pat. No. 3,143,385. Such a terminal has its own problems in that it is more expensive to produce and it requires the use of a split cylindrical sleeve as a separate retainer means, which further adds to the cost.

SUMMARY OF THE INVENTION

The present invention overcomes the above discussed problems of the prior art by providing a stamped and formed electrical terminal having a contact portion and a crimp portion with a smooth surface of transition being provided between the contact and crimp portions whereby the terminal is structurally strengthened, has improved electrical properties, and has the capability of being inserted into and withdrawn from a seal without damaging the seal. The contact portion of the subject terminal can have either a pin or a socket configuration. The crimp portion preferably includes both a conductor crimp barrel and a strain relief crimp barrel. The terminal is preferably retained in an associated connector housing by means of an external, auxillary latching means.

It is therefore an object of the present invention to produce an improved stamped and formed electrical terminal capable of carrying higher currents than standard contacts, having a stronger transition area between contact body and crimp portions, and reduced current density in the transition area.

It is another object of the present invention to produce an improved electrical terminal having entirely closed seams in the contact, transition, and crimp portions of the terminal so that the terminals can be used in post molding operations.

It is still another object of the present invention to produce an improved electrical terminal of either the pin or socket type in which a smooth surface of transition is provided between contact and crimp portions of the terminal thereby enabling insertion and withdrawal through a seal or the like without damage to the seal by the terminal.

It is a further object of the present invention to produce an improved electrical terminal which can economically be substituted for a known screw machine formed part while meeting all of the necessary reliability requirements.

It is a still further object of the present invention to produce an improved electrical terminal which can be readily and economically manufactured.

The means for accomplishing the foregoing objects and other advantages of the present invention will become apparent to those skilled in the art from the following detailed description taken with reference to the accompanying drawings.

DETAILED DESCRIPTION OF THE PREFERRED EMBODIMENT

Figure 1:
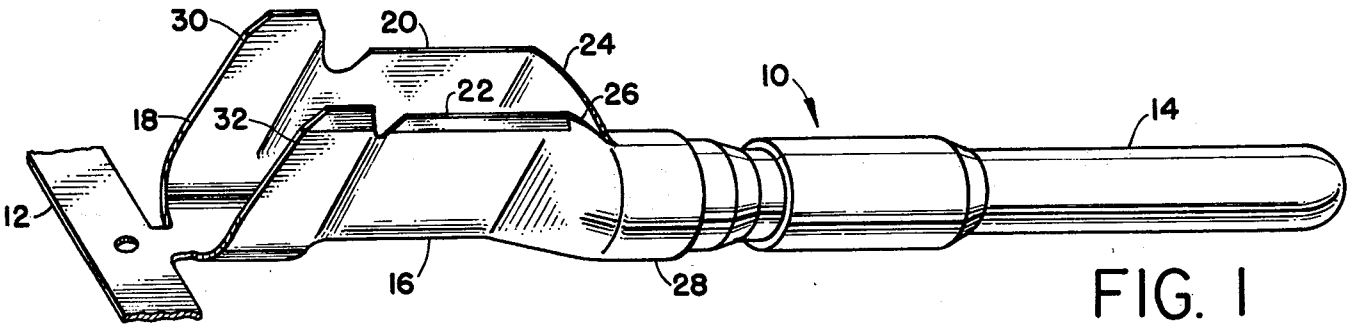
FIG. 1 is a perspective view of a pin terminal incorporating the subject invention.

A stamped and formed pin terminal 10 incorporating the subject invention is shown in FIG. 1 in an uncrimped state as it would be formed extending from a marginal edge of a carrier strip 12. The terminal 10 includes a pin contact portion 14, a crimp barrel 16, and a strain relief barrel 18. The crimp barrel includes a pair of parallel spaced side walls 20, 22 extending from opposite sides of a base web (not shown) and connected at their forward ends by forward flared portions 24, 26, respectively, to a rear barrel portion 28 of the terminal 10. The strain relief barrel 18 of the terminal includes a pair of rearward flared portions 30, 32 extending upwardly from and as extensions of side walls 20, 22, respectively.

Figure 2:
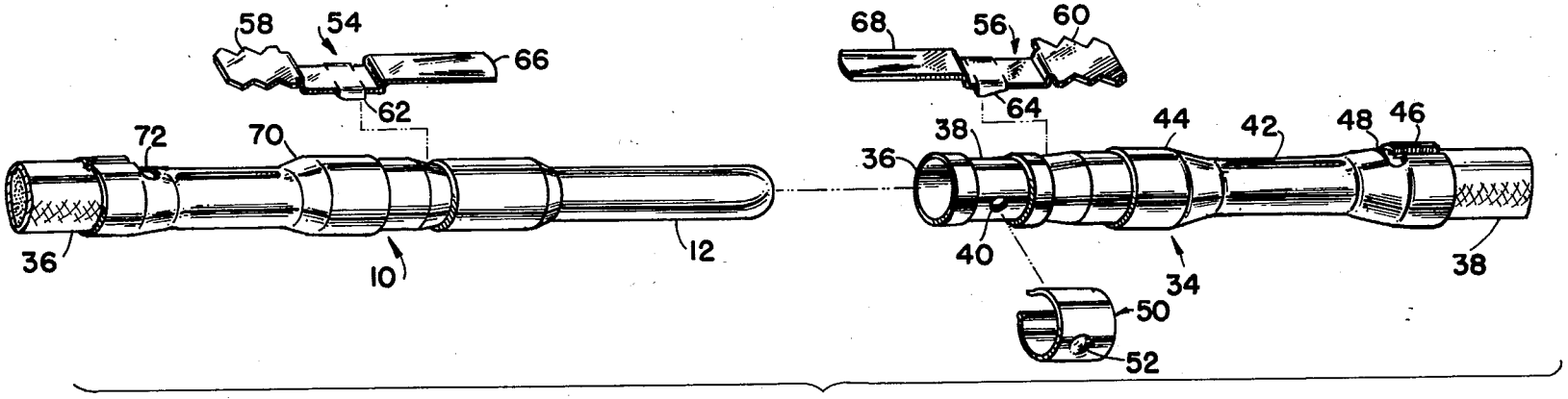
FIG. 2 is an exploded perspective view of a pin and socket terminal combination incorporating the subject invention.

The pin terminal of FIG. 1 and a mating socket terminal 34 are shown in FIG. 2 each crimped to a respective conductor 36, 38. The socket terminal 34 has a receptacle portion 36 with an outer annular recess 38 and an aperture 40. The receptacle portion is connected to crimp barrel 42 by a smooth surface of transition 44. Similarly the strain relief crimp 46 is connected to the crimp barrel 42 by a smooth surface of transition 48. A spring clip 50 is mounted in the recess 38 of the receptacle portion 36 with a detent 52 received in an aperture 40 to apply a bias against the pin portion 14 of pin terminal 10. Also shown in FIG. 2 are a pair of contact retaining contact clips 54, 56 which are similar to those described in U.S. Pat. No. 4,147,400, the disclosure of which is incorporated herein by reference. Each retaining clip includes a mounting portion 58, 60, a terminal engaging tine portion 62, 64, and a release blade 66, 68.

It will be noted from FIG. 2 that smooth surfaces of transitions 44, 48, 70, 72 are formed on each terminal at each end of the crimped crimp barrel. Thus the terminal has a smooth outer surface substantially devoid of sharp edges and projections.

Figure 3:
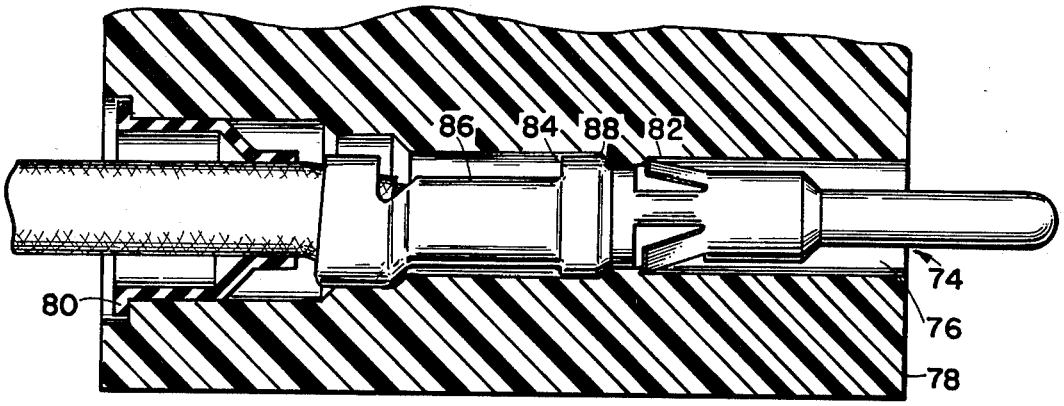
FIG. 3 PRIOR ART
FIG. 3 is a side elevation, partially in section, showing a prior art electrical terminal mounted in a suitably sealed housing.
Figure 4:
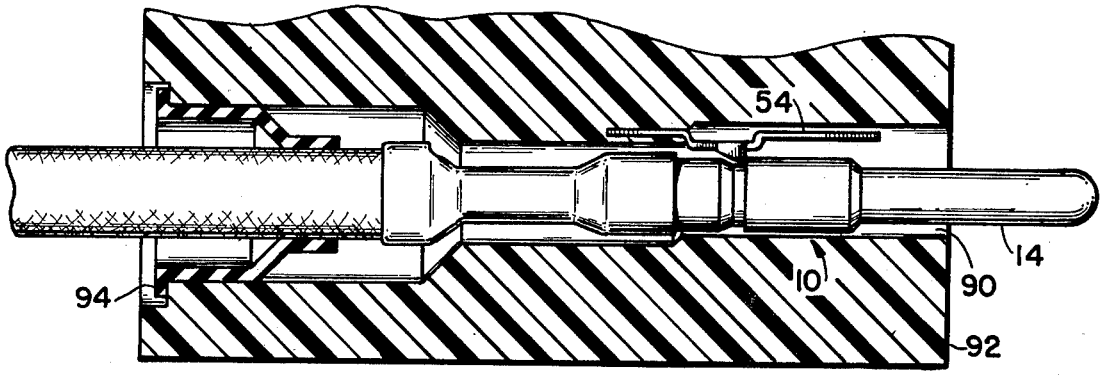
FIG. 4 is a side elevation, partially in section, showing the subject invention incorporated into a pin terminal mounted in a sealed connector housing.
Figure 5:
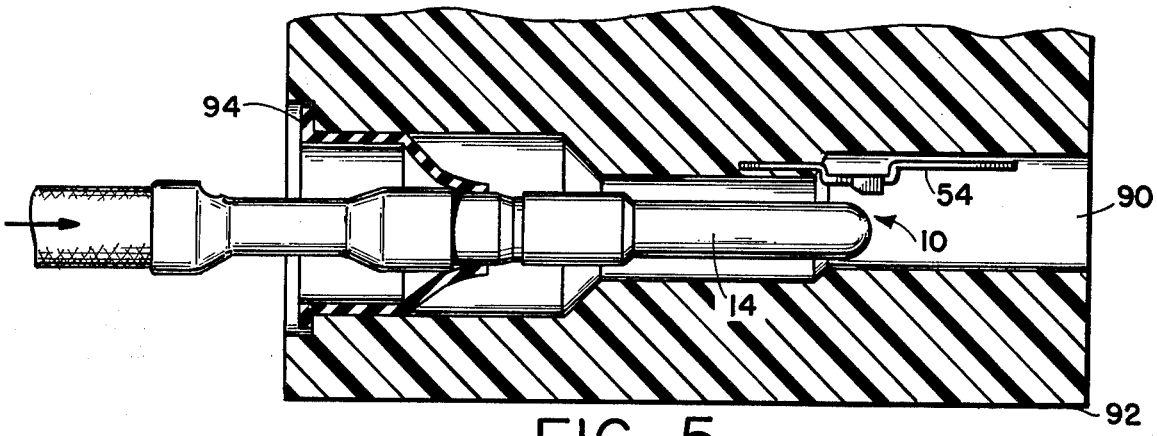
FIG. 5 is a side elevation, similar to FIG. 4, showing the subject pin terminal during insertion through the seal and into the housing.

FIGS. 3-5 demonstrate a particular advantage of the subject terminal. A known prior art terminal 74 is shown in FIG. 3 mounted in a bore 76 of a housing 78 which is closed at its rear end by a seal 80. The seal is of the type disclosed in U.S. Pat. No. 4,150,866, the disclosure of which is incorporated herein by reference. The terminal 74 includes a plurality of retention tines 82 and can be seen to have a sharp shoulder 84 between the crimped barrel 86 and the main body 88 of the terminal. Clearly when this terminal is inserted into or withdrawn from the seal 80 there is the substantial probability that the seal will be damaged, if not destroyed, by these sharp edges and projections.

FIGS. 4 and 5 show the subject terminal 10 in a bore 90 of a similar housing 92 and seal 94. FIG. 4 shows the terminal 10 in a fully seated condition with the retaining spring 54 engaging and holding the terminal in position. FIG. 5 shows how the smooth transition zones of the subject terminal allow the terminal to be inserted into and withdrawn from the seal without causing unnecessary damage to the seal.

It should also be pointed out that by providing these zones of transition the subject terminal is stronger in the area of between the contact portion and the crimp portion and between the crimp portion and the strain relief portion of the terminal. This also reduces the current density in the transition area while providing a smooth non-sharp transition to the crimp area. The crimp area thus can be effectively entirely closed so that the subject terminal is also suitable for post molding operations.

The present invention may be subject to many modifications and changes without departing from the spirit or essential characteristics thereof. The present embodiment is therefore to be considered in all respects as illustrative and not restrictive of the scope of the invention.

What is claimed is:

1. An improved stamped and formed electrical connector comprising:

a barrel shaped contact portion;

a crimp barrel portion; and a conically tapered continuous intermediary portion providing a smooth unbroken surface of transition between said crimp barrel portion and said contact barrel portion in a crimped condition.

2. The terminal according to claim 1 wherein said contact barrel portion is a pin.

3. A terminal according to claim 1 wherein said contact barrel portion is a receptacle.

4. A terminal according to claim 1 wherein said contact barrel portion is a receptacle further including spring means.

5. A terminal according to claim 1 further comprising a strain relief crimp adjacent said crimp barrel portion.

6. A terminal according to claim 5 further comprising a second conically tapered intermediary portion providing a smooth surface of transition between said crimp barrel portion and said strain relief crimp.

7. An improved stamped and formed electrical terminal comprising:

a contact portion, a crimp barrel portion, and a continuous profiled portion between said crimp barrel portion and said contact portion which upon crimping said terminal to a respective conductor provides a smooth unbroken zone of transition giving the terminal an exterior profile devoid of sharp projections.

8. An improved stamped and formed electrical terminal according to claim 7 wherein:

said profiled portion provides additional strength in said zone of transition while reducing current density.

9. An improved stamped and formed electrical terminal according to claim 7 wherein:

crimped seams of said crimp barrel portion are entirely closed whereby said terminal can be post molded.

10. An improved stamped and formed electrical terminal according to claim 7 wherein:

said contact portion is a receptacle having socket with an annular recess adjacent the free end thereof and at least one aperture in said recess, and an elliptical spring member having at least one inwardly directed dimple, said spring member being mounted in said recess with said dimple projecting through a respective aperture to provide high normal force to a mating terminal.

* * * * *